US010401750B2

(12) United States Patent
Nakamura et al.

(10) Patent No.: US 10,401,750 B2
(45) Date of Patent: Sep. 3, 2019

(54) TONER

(71) Applicant: CANON KABUSHIKI KAISHA, Tokyo (JP)

(72) Inventors: Kunihiko Nakamura, Gotemba (JP); Kenta Kamikura, Yokohama (JP); Maho Tanaka, Tokyo (JP); Fumiya Hatakeyama, Kawasaki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/975,064

(22) Filed: May 9, 2018

(65) Prior Publication Data

US 2018/0329329 A1 Nov. 15, 2018

(30) Foreign Application Priority Data

May 15, 2017 (JP) ..... 2017-096516

(51) Int. Cl.
*G03G 9/093* (2006.01)
*G03G 9/097* (2006.01)
(Continued)

(52) U.S. Cl.
CPC ..... *G03G 9/09335* (2013.01); *G03G 9/0819* (2013.01); *G03G 9/0821* (2013.01);
(Continued)

(58) Field of Classification Search
CPC ..... G03G 9/09335; G03G 9/09725; G03G 9/09716; G03G 9/09708; G03G 9/08711;
(Continued)

(56) References Cited

U.S. PATENT DOCUMENTS 7,927,775 B2 4/2011 Komatsu et al.
7,939,233 B2 5/2011 Inoue et al.
(Continued)

FOREIGN PATENT DOCUMENTS

JP H0527473 A 2/1993
JP 3943781 B2 7/2007
(Continued)

OTHER PUBLICATIONS

U.S. Appl. No. 15/969,318, Tsuneyoshi Tominaga, filed May 2, 2018.
(Continued)

*Primary Examiner* — Thorl Chea
(74) *Attorney, Agent, or Firm* — Venable LLP

(57) ABSTRACT

Provided is a toner comprising a toner particle including a toner base particle and fine particles present on a surface of the toner base particle, wherein each of the fine particles includes a core fine particle and a condensate of at least one organosilicon compound selected from the group consisting of organosilicon compounds represented by specific structural formulas, the condensate coating the surface of the core fine particle, and in a wettability test of the toner with respect to a methanol/water mixed solvent, a methanol concentration, when a transmittance of light having a wavelength of 780 nm is 50%, is 5.0 to 20.0% by volume:

(1)

(Continued)

-continued (2)

in above Formulas, each of $R^a$, $R^b$ and $R^c$ independently represents an alkyl group, an alkenyl group, an acetoxy group, an acyl group, an aryl group, or a methacryloxyalkyl group, $R^1$ to $R^5$ each independently represents a halogen atom or an alkoxy group.

8 Claims, 5 Drawing Sheets

(51) Int. Cl.
*G03G 9/08* (2006.01)
*G03G 9/087* (2006.01)

(52) U.S. Cl.
CPC ..... *G03G 9/0825* (2013.01); *G03G 9/08711* (2013.01); *G03G 9/08728* (2013.01); *G03G 9/08755* (2013.01); *G03G 9/09364* (2013.01); *G03G 9/09371* (2013.01); *G03G 9/09385* (2013.01); *G03G 9/09708* (2013.01); *G03G 9/09716* (2013.01); *G03G 9/09725* (2013.01); *G03G 9/09775* (2013.01)

(58) Field of Classification Search
CPC ..... G03G 9/09775; G03G 9/08728; G03G 9/08755; G03G 9/0821; G03G 9/0819; G03G 9/09371; G03G 9/09385; G03G 9/0825; G03G 9/09364
See application file for complete search history.

(56) References Cited

U.S. PATENT DOCUMENTS

| | | | | |
|---|---|---|---|---|
| 8,137,886 | B2 | 3/2012 | Baba et al. | |
| 8,142,972 | B2 | 3/2012 | Hotta et al. | |
| 8,288,069 | B2 | 10/2012 | Fujikawa et al. | |
| 8,828,639 | B2 | 9/2014 | Kamikura et al. | |
| 8,986,914 | B2 | 3/2015 | Fujikawa et al. | |
| 9,034,549 | B2 | 5/2015 | Shiotari et al. | |
| 9,261,806 | B2 | 2/2016 | Moribe et al. | |
| 9,298,116 | B2 | 3/2016 | Maetani et al. | |
| 9,354,534 | B2 | 5/2016 | Okada | |
| 9,423,708 | B2 | 8/2016 | Tominaga et al. | |
| 9,594,323 | B2 | 3/2017 | Fujikawa et al. | |
| 9,733,583 | B2 | 8/2017 | Kuroki et al. | |
| 9,829,820 | B2 | 11/2017 | Masumoto et al. | |
| 9,880,478 | B2 | 1/2018 | Shimano et al. | |
| 9,897,933 | B2 | 2/2018 | Yoshida et al. | |
| 9,921,501 | B2 | 3/2018 | Mochizuki et al. | |
| 9,952,523 | B2 | 4/2018 | Shimano et al. | |
| 2009/0246675 | A1 | 10/2009 | Nakamura et al. | |
| 2010/0028796 | A1 | 2/2010 | Nakamura et al. | |
| 2010/0183971 | A1 | 7/2010 | Fujikawa et al. | |
| 2018/0329325 | A1* | 11/2018 | Hatakeyama ..... | G03G 9/0825 |

FOREIGN PATENT DOCUMENTS

| | | | |
|---|---|---|---|
| JP | 2015-055743 | A | 3/2015 |
| JP | 2015-106023 | A | 6/2015 |
| JP | 2016-200815 | A | 12/2016 |

OTHER PUBLICATIONS

U.S. Appl. No. 15/973,661, Kenta Kamikura, filed May 8, 2018.
U.S. Appl. No. 15/974,187, Sara Yoshida, filed May 8, 2018.
U.S. Appl. No. 15/974,917, Kunihiko Nakamura, filed May 9, 2018.
U.S. Appl. No. 15/974,928, Fumiya Hatakeyama, filed May 9, 2018.
U.S. Appl. No. 15/974,936, Kenta Kamikura, filed May 9, 2018.
U.S. Appl. No. 15/974,969, Maho Tanaka, filed May 9, 2018.
U.S. Appl. No. 15/975,305, Kentaro Yamawaki, filed May 9, 2018.

* cited by examiner

TONER

BACKGROUND OF THE INVENTION

Field of the Invention

The present invention relates to a toner for use in an image forming method such as electrophotography and electrostatic printing.

Description of the Related Art

In recent years, the development of computers and multimedia created a demand for means for outputting high-definition full-color images in a wide range of fields from office to home, and further improvement in toner performance is needed.

In particular, a number of research have been conducted for attaching and embedding fine particles to the toner surface for the purpose of improving image quality.

Japanese Patent Application Publication No. 2016-200815 discloses a toner having a toner particle with a surface layer including an organosilicon polymer in which the surface roughness of the toner particle is regulated for the purpose of improving transferability.

Japanese Patent Application Publication No. 2015-106023 discloses a toner in which organic fine particles with a size of at least 50 nm and not more than 150 nm are adhered to a toner core and then coated with a melamine resin or a urea resin for the purpose of suppressing the detachment of the fine particles, Japanese Patent Application Publication No. 2015-055743 discloses a toner having a shell including a high-hardness thermosetting resin in which silica fine particles or titanium fine particles are adhered to a toner core and then coated with a melamine resin or a urea resin in order to improve low-temperature fixability.

SUMMARY OF THE INVENTION

In the toner of Japanese Patent Application Publication No. 2016-200815, protrusions having an appropriate density and including an organosilicon polymer are formed on the toner surface. Therefore, when a stress is applied to the toner, the protrusions of the toner surface exert a spacer effect, and good transferability can be maintained even when the number of prints is large.

However, in the research conducted by the inventors of the present invention, the image density sometimes changed under a low-humidity environment. This change apparently occurs because the organosilicon polymer on the toner surface cannot diffuse charges and the charge quantity of the toner exhibits difficulty in saturate, that is, because of low charge rising performance.

In the toner of Japanese Patent Application Publication No. 2015-106023, detachment of the organic fine particles configuring the protrusions can be suppressed. However, since the surface of the toner particle is an organic shell layer such as a melamine resin or a urea resin, the flowability of the toner cannot be ensured only by the toner particles, and it is necessary to add titanium oxide particles or hydrophobic silica particles to the toner particles to form a toner.

In this case, the transferability can deteriorate when the number of prints is large. This is apparently because the added titanium oxide particles or silica particles are embedded in the toner particles when the number of prints is large, and the flowability improving effect is lowered.

In the toner of Japanese Patent Application Publication No. 2015-055743, the thermosetting shell layer is fractured from the silica fine particle or titanium fine particle as a starting point, and the fixing performance is improved. However, in some cases, the bonding force between the fine particle and the shell layer is weak, and the fine particles, which are the protrusions, are detached and the developing member is contaminated.

As described above, in the related art, ensuring the presence of fine particles on the surface of a toner particle is not sufficient for providing a toner excellent in transferability and charge rising performance and reduced in member contamination, and there is still room for improvement.

The present invention has been created with the foregoing in view and provides a toner excellent in transferability and charge rising performance and reduced in member contamination.

The present invention relates to a toner including a toner particle including:

a toner base particle; and fine particles present on a surface of the toner base particle, wherein each of the fine particles includes:

a core fine particle; and a condensate of at least one organosilicon compound selected from the group consisting of an organosilicon compound represented by Formula (1) below and an organosilicon compound represented by Formula (2) below, the condensate coating the surface of the core fine particle, and in a wettability test of the toner with respect to a methanol/water mixed solvent, a methanol concentration, when a transmittance of light having a wavelength of 780 nm is 50%, is at least 5.0% by volume and not more than 20.0% by volume.

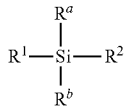

(1)

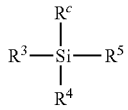

(2)

(in Formulas (1) and (2), each of $R^a$, $R^b$ and $R^c$ independently represents an alkyl group, an alkenyl group, an acetoxy group, an acyl group, an aryl group, or a methacryloxyalkyl group, $R^1$, $R^2$, $R^3$, $R^4$ and $R^5$ each independently represents a halogen atom or an alkoxy group).

According to the present invention, it is possible to provide a toner excellent in transferability and charge rising performance and reduced in member contamination.

Further features of the present invention will become apparent from the following description of exemplary embodiments with reference to the attached drawings.

DESCRIPTION OF THE EMBODIMENTS

Figure 1:
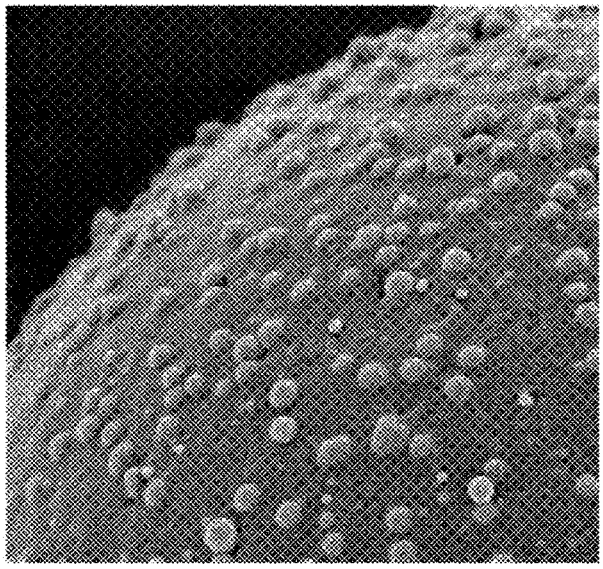
FIG. 1 is a scanning electron microphotograph (a photograph substituted for a drawing) of the toner of the present invention.

In the present invention, the expression "at least AA and not more than BB" and "AA to BB" representing a numerical range means a numerical range including a lower limit and an upper limit which are endpoints unless otherwise specified.

The present invention provides a toner having a toner particle including:

a toner base particle; and fine particles present on a surface of the toner base particle, wherein each of the fine particles includes:

a core fine particle; and a condensate of at least one organosilicon compound selected from the group consisting of an organosilicon compound represented by Formula (1) below and an organosilicon compound represented by Formula (2) below, the condensate coating the surface of the core fine particle, and in a wettability test of the toner with respect to a methanol/water mixed solvent, a methanol concentration, when a transmittance of light having a wavelength of 780 nm is 50%, is at least 5.0% by volume and not more than 20.0% by volume.

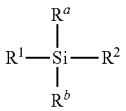

(1)

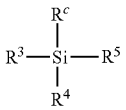

(2)

(in Formulas (1) and (2), each of $R^a$, $R^b$ and $R^c$ independently represents an alkyl group, an alkenyl group, an acetoxy group, an acyl group, an aryl group, or a methacryloxyalkyl group, $R^1$, $R^2$, $R^3$, $R^4$ and $R^5$ each independently represents a halogen atom or an alkoxy group).

The outline of the present invention will be described below.

The toner particle includes a toner base particles and fine particles present on the surface of the toner base particle.

The fine particle includes a core fine particle and a condensate of at least one organosilicon compound selected from the group consisting of an organosilicon compound represented by Formula (1) and an organosilicon compound represented by Formula (2), the condensate coating the surface of the core fine particle (can be simply referred to hereinbelow as "the condensate of an organosilicon compound").

The condensate of an organosilicon compound coats the surface of the core fine particle. Further, the condensate of an organosilicon compound has a function of suppressing the detachment of the fine particles from the toner base particle.

In order to attain a printing quality which does not change even when the number of prints is large, it is required that the surface of the toner does not easily deteriorate and that member contamination due to the detachment of fine particles be suppressed. In order to suppress the member contamination, it is preferable that the surface of the fine particles present in the toner be hard.

With an organic resin, it is difficult to achieve this hardness. It has been found that a condensate of at least one organosilicon compound selected from the group consisting of an organosilicon compound represented by Formula (1) and an organosilicon compound represented by Formula (2), these compounds being inorganic compounds having a siloxane bond (—Si—O—Si—) as a main skeleton and an appropriate crosslinked structure, is suitable for achieving this hardness.

Meanwhile, with the conventional method for embedding fine particles of an inorganic compound into a toner particle with a mechanical impact force, the fine particles were sometimes detached from the toner particle during printing of a large number of sheets.

By contrast, it has been found that the detachment of the fine particle can be suppressed by coating the surface of a core fine particle with the condensate of an organosilicon compound when the condensate is a low-molecular-weight material, and by fixedly attaching the condensate to the toner base particle, and then increasing the degree of condensation of the condensate.

This is apparently because when the fine particles are embedded with a mechanical impact force, some of the fine particles and the toner base particles are fixed by a contact force.

By contrast, since a low-molecular-weight condensate obtained from at least one organosilicon compound selected from the group consisting of an organosilicon compound represented by Formula (1) and an organosilicon compound represented by Formula (2) is flexible, the contact area between the core fine particles and the toner base particles can be widened by wetting, and action similar to that of an adhesive can be demonstrated.

Further, it has been found that when the wettability of the toner having the condensate of an organosilicon compound is high, the charge rising performance is markedly improved.

Specifically, in a wettability test of the toner with respect to a methanol/water mixed solvent, a methanol concentration when a transmittance of light having a wavelength of 780 nm is 50% be at least 5.0% by volume and not more than 20.0% by volume. Further, the methanol concentration is preferably at least 7.0% by volume and not more than 20.0% by volume.

It is well known that in the case of conventional toners, a higher methanol concentration is preferred.

Conventionally, inorganic fine particles such as silica fine particles and titanium oxide fine particles have been added to the toner particles for the purpose of imparting flowability. In addition, in order to maintain a high charge quantity even in a high-humidity environment, these fine particles are treated with a silane coupling agent such as hexamethyldisilazane to hydrophobize the surface of the fine particles and increase the methanol concentration.

By contrast, the toner has such characteristics in a range of the methanol concentration from at least 5.0% by volume to not more than 20.0% by volume in which, according to the conventional concept, it is considered that the hygroscopicity is high and the image is degraded under a high-humidity environment. However, due to the characteristics, the charge rising performance of the toner can be improved while maintaining the charging performance under a high-humidity environment.

The following mechanism can be assumed to explain this effect.

A toner having low charge rising performance, as referred to herein, is a toner in which the charge quantity continues to increase as the toner and the charging member come into contact with each other. This phenomenon occurs because the electric resistance of the toner surface layer is very high, and the electric charge continues to stay on a part of the toner surface layer and does not diffuse to the entire toner, so that the charge quantity of the toner is slow to saturate.

In the toner of the present invention, protrusions are formed by fine particles. The protrusions contact the charging member, whereby the toner is charged. The protrusions formed by the fine particles are brought into close contact with the toner base particle by the condensate of an organosilicon compound. Further, it is considered that due to the condensate of an organosilicon compound, the toner charge quantity is rapidly saturated while charges are caused to diffuse uniformly throughout the toner through the Si—O—Si bonds of the condensate.

The methanol concentration is an index indicating whether the Si—O—Si bonds of the condensate are densely formed on the outermost surface of the toner base particle.

When the methanol concentration is not more than 20.0% by volume, the Si—O—Si bonds are densely formed, and electric charges can be uniformly and sufficiently diffused throughout the toner.

Meanwhile, the hygroscopicity of the Si—O—Si bond is low as compared with the functional group on the surface of the conventional toner, for example, a hydroxyl group (—OH) or a carboxy group (—COOH). Therefore, even when the methanol concentration is not more than 20.0% by volume, sufficient charging performance can be achieved, unlike with the conventional toner, even under a high-humidity environment. By densely forming the Si—O—Si bonds, it is also possible to simultaneously suppress the detachment of the fine particles from the toner base particle.

When the methanol concentration is higher than 20.0% by volume, it appears that the site where the condensate of the organosilicon compound is not present remains. As a result, it becomes difficult to diffuse the charge throughout the toner through the Si—O—Si bonds, and the charge rising performance deteriorates.

A method for adjusting the methanol concentration within the abovementioned range can be exemplified by controlling the hydrolysis conditions and the condensation reaction conditions of at least one organosilicon compound selected from the group consisting of an organosilicon compound represented by Formula (1) and an organosilicon compound represented by Formula (2) at the time of coating the surface of the core fine particle.

Specifically, a method can be used in the process of manufacturing the toner includes a step of mixing and condensing core fine particles, toner base particles and an organosilicon compound having a silanol group and obtained by mixing at least one of an organosilicon compound represented by Formula (1) and an organosilicon compound represented by Formula (2) with water and hydrolyzing.

Preferable conditions can be exemplified by setting the pH at the time of hydrolysis of the organosilicon compound to not more than 7, raising the temperature at the time of the condensation reaction, prolonging the condensation reaction time, and the like.

In addition, it is preferable that the surface of the toner base particle excluding the fine particles be coated with a condensate of at least one organosilicon compound selected from the group consisting of an organosilicon compound represented by Formula (1) and an organosilicon compound represented by Formula (2).

When the surface of the toner base particle is coated with the condensate of the organosilicon compound, the electric charge can be diffused by the entire toner, and the charge rising performance can be further effectively improved. In addition, the adhesion between the toner particles can be further reduced, and the transferability can be further improved.

The coverage ratio of the surface of the toner base particle, excluding the fine particles, with the condensate of at least one organosilicon compound selected from the group consisting of the organosilicon compound represented by Formula (1) and the organosilicon compound represented by Formula (2) is preferably at least 0.1% by area and not more than 90.0% by area, and more preferably at least 2.0% by area and not more than 70.0% by area.

The coverage ratio can be calculated from an image obtained by binarizing a backscattered electron image captured by a scanning electron microscope (SEM).

Details of the calculation procedure will be described hereinbelow.

The coverage ratio can be adjusted to the abovementioned range by the type and addition amount of the organosilicon compound, production conditions of the toner particles, and the like.

Specific examples of the organosilicon compound represented by Formula (1) below and the organosilicon compound represented by Formula (2) will be described hereinbelow.

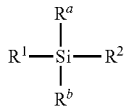

(1)

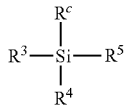

(2)

(in Formulas (1) and (2), each of $R^a$, $R^b$ and $R^c$ independently represents an alkyl group, an alkenyl group, an acetoxy group, an acyl group, an aryl group, or a methacryloxyalkyl group, $R^1$, $R^2$, $R^3$, $R^4$ and $R^5$ each independently represents a halogen atom, a hydroxyl group, or an alkoxy group).

In Formulas (1) and (2), the number of carbon atoms of the alkyl group is preferably at least 1 and not more than 12, and more preferably at least 1 and not more than 6.

The number of carbon atoms of the alkenyl group is preferably at least 2 and not more than 6, and more preferably at least 2 and not more than 4.

The number of carbon atoms of the acyl group is preferably at least 2 and not more than 6, and more preferably at least 2 and not more than 4.

The number of carbon atoms of the aryl group is preferably at least 6 and not more than 14. The aryl group is preferably a phenyl group.

The number of carbon atoms of the alkyl group in the methacryloxyalkyl group is preferably at least 1 and not more than 6, and more preferably at least 1 and not more than 4.

The number of carbon atoms of the alkoxy group is preferably at least 1 and not more than 10, and more preferably at least 1 and not more than 6.

Specific examples of the organosilicon compound represented by Formula (1) include difunctional silane compounds such as dimethyldimethoxysilane and dimethyldiethoxysilane.

Specific examples of the organosilicon compound represented by Formula (2) are presented hereinbelow.

Trifunctional methylsilanes such as methyltrimethoxysilane, methyltriethoxysilane, methyldiethoxymethoxysilane, and methylethoxydimethoxysilane.

Trifunctional silane compounds such as ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltriethoxysilane and octyltrimethoxysilane.

Trifunctional phenylsilanes such as phenyltrimethoxysilane and phenyltriethoxysilane.

Trifunctional vinylsilanes such as vinyltrimethoxysilane and vinyltriethoxysilane.

Trifunctional allylsilanes such as allyltrimethoxysilane, allyltriethoxysilane, allyldiethoxymethoxysilane and allylethoxydimethoxysilane.

Trifunctional methacryloxyalkylsilanes such as γ-methacryloxypropyltrimethoxysilane, γ-methacryloxypropyltriethoxysilane, γ-methacryloxypropyldiethoxymethoxysilane and γ-methacryloxypropylethoxydimethoxysilane.

Further, a silane compound other than the abovementioned silane compounds may be used in combination.

Specific examples thereof include monofunctional silane compounds such as trimethylethoxysilane, triethylmethoxysilane, triethylethoxysilane, triisobutylmethoxysilane, triisopropylmethoxysilane and tri-2-ethylhexylmethoxysilane, and tetrafunctional silane compounds such as tetramethoxysilane, tetraethoxysilane, tetrapropoxysilane and tetrabutoxysilane.

From the viewpoints of transferability, suppression of member contamination and charge rising performance, it is preferable that the content of the condensate of at least one organosilicon compound selected from the group consisting of the organosilicon compound represented by Formula (1) and the organosilicon compound represented by Formula (2) be at least 0.1 parts by mass and not more than 20.0 parts by mass, and more preferably at least 0.5 parts by mass and not more than 15.0 parts by mass with respect to 100 parts by mass of the toner base particles.

Since the core fine particles are coated with the condensate of an organosilicon compound, the detachment of the fine particles from the toner base particle can be suppressed while ensuring the hardness thereof.

When the organosilicon compound is a compound represented by Formula (2), it is possible to form a crosslinked structure on the surface of the toner base particle, so that member contamination can be further suppressed.

The method of preparing the fine particles is not particularly limited, and can be exemplified by a method of condensing by adding an organosilicon compound in a state in which the core fine particles and the toner base particles are copresent in an aqueous medium.

In this method, it is preferable that the condensate of the organosilicon compound cover not only the surface of the core fine particle but also at least a part of the toner base particles.

The organosilicon compound may be added to the aqueous medium by an arbitrary method.

The organosilicon compound may be added as it is, but from the viewpoint of facilitating the control of the methanol concentration, it is preferable that the organosilicon compound be added after mixing with an aqueous medium and preliminarily hydrolyzing.

The hydrolyzable organosilicon compound undergoes a condensation reaction after the hydrolysis. Since the optimum pH of these two reactions differ from each other, it is more preferable that the organosilicon compound and the aqueous medium be mixed in advance, the hydrolysis be performed at a pH at which the hydrolysis reaction proceeds rapidly, and the condensation reaction be thereafter implemented at a pH optimum for the condensation reaction, because the reaction time can be shortened.

In order to form protrusions on the surface of the toner base particle and to improve the adhesion strength between the toner base particle and the fine particles, the number average particle diameter of the core fine particles is preferably at least 10 nm and not more than 500 nm, and more preferably at least 30 nm and not more than 300 nm.

When the number average particle diameter of the core fine particles is within the above range, protrusions of an appropriate size are formed on the surface of the toner base particle, and the attachment force of the toner is reduced, whereby the transferability of the toner is further improved.

The content of the core fine particles is preferably at least 0.1 parts by mass and not more than 20.0 parts by mass, and more preferably at least 0.2 parts by mass and not more than 10.0 parts by mass with respect to 100 parts by mass of the toner base particles.

It is preferable that the protrusions formed by the fine particles be formed on the surface of the toner base particles in an appropriate size and in an appropriate presence state.

For example, in one embodiment, the fine particles are present in a state of being embedded in the toner base particle.

Specifically, where the distance between the highest point of the portion (protrusion) of the fine particle protruding from the toner base particle and the lowest point of the deepest portion of the embedded fine particle in the toner base particle is defined as a fine particle diameter R, and the distance between the lowest point of the deepest portion of the embedded fine particle in the toner base particle and the surface of the toner base particle is defined as a fine particle embedding length r, it is preferable that the embedding ratio of the fine particle to the toner base particle expressed by $r/R \times 100$ be at least 20% and not more than 80%, and more preferably at least 30% and not more than 70%.

When the embedding ratio is within the above range, appropriate protrusions created by the fine particles are formed on the surface of the toner base particle, and sufficient flowability and transferability can be imparted to the toner.

Further, since the fine particles are appropriately embedded in the toner base particle, the attachment force between the toner base particle and the fine particles is increased, and the fine particles are less likely to be detached from the toner base particle.

Figure 2:
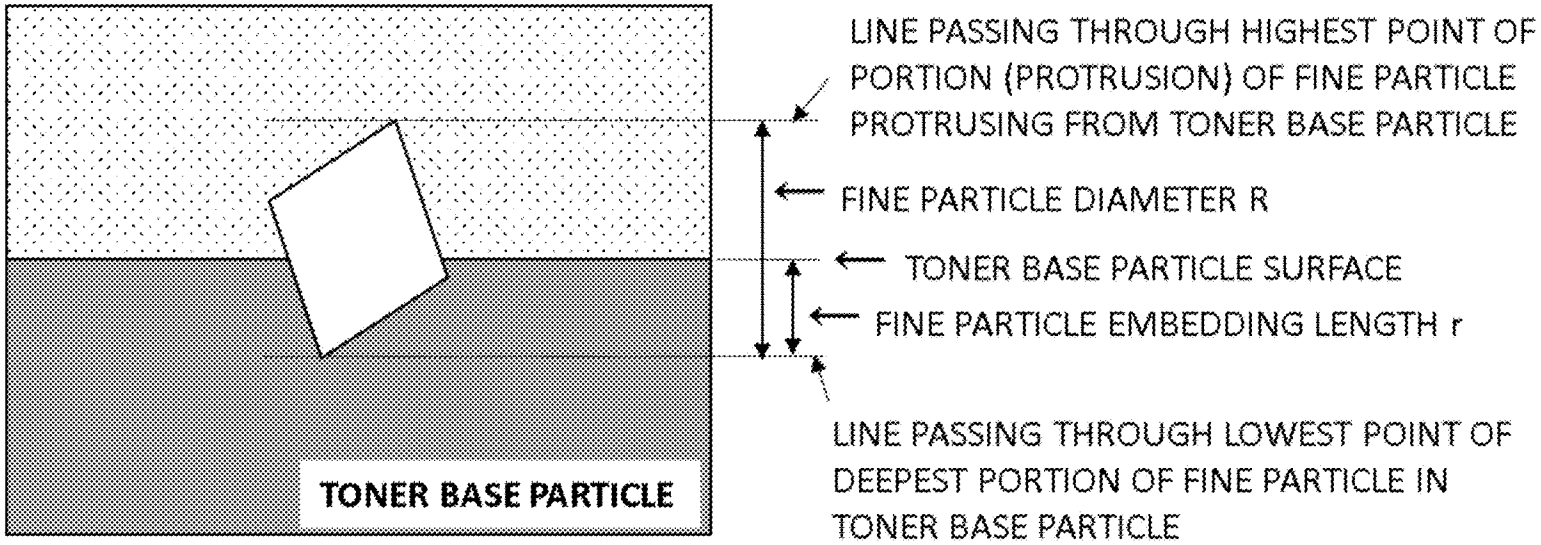
FIG. 2 is a diagram for explaining a calculation procedure of an embedding ratio of fine particles from a cross-sectional image.

The embedding ratio is calculated from cross-sectional observation of the toner using a transmission electron microscope (TEM) (see FIG. 2). Details will be described hereinbelow.

The core fine particles are not particularly limited, and can be exemplified by inorganic fine particles such as silica fine particles, titania fine particles, alumina fine particles and hydrotalcite fine particles, and polymer-based resin fine particles such as polymethyl methacrylate resin fine particles, urethane resin fine particles, phenolic resin fine particles and polystyrene resin fine particles.

From the viewpoint of maintaining transferability when the number of prints is large, inorganic fine particles are preferable. Meanwhile, from the viewpoint of fixing performance, resin fine particles are preferable. Since the inorganic fine particles themselves have high hardness, the fine particles are hardly changed in shape even when the number of prints is large, and the decrease in transferability can be suppressed. In addition, since the reactivity with the organosilicon compound is high, the condensate layer of the organosilicon compound which is strongly attached to the surface can be formed, so that member contamination caused by the detachment of fine particles can also be further prevented.

Meanwhile, the resin fine particles themselves melt at the time of fixing and can promote the fixing.

Two or more types of the core fine particles may be used in combination. When two or more types of core fine particles are used in combination, each of the obtained fine particles can impart a separate function to the toner.

For example, when core fine particles having different particle diameters are used in combination, the core fine particle having a small particle diameter can improve the flowability of the toner, and the core fine particle having a large particle diameter can improve the transferability.

In addition, core fine particles different in constituent material, surface state, and particle shape may be used in combination.

Further, where the obtained fine particles of one type meet the above requirements, the fine particles of the other type may not satisfy the above requirements.

The coverage ratio of the fine particles with respect to the surface of the toner base particle is preferably at least 5% by area and not more than 70% by area, and more preferably at least 10% by area and not more than 50% by area.

When the coverage ratio is within the above range, the charging performance is further improved. A method for calculating the coverage ratio will be described hereinbelow.

The coverage ratio can be controlled to the abovementioned range mainly by controlling the number average particle diameter, addition amount, type, and the like of the core fine particles.

Meanwhile, the fixed attachment ratio of the fine particles to the toner base particle is preferably at least 70% and not more than 100%, and more preferably at least 80% and not more than 100%.

When the fixed attachment ratio is within the above range, the state change of the toner base particle surface is small even when the number of prints is large, and the transferability can be maintained. A method for calculating the fixed attachment ratio will be described hereinbelow.

Next, methods for producing a toner particle including fine particles on the surface of a toner base particle will be described, but the present invention is not limited thereto.

The first production method involves preparing a mixed liquid including at least one of an organosilicon compound represented by Formula (1) and an organosilicon compound represented by Formula (2), or a hydrolyzate thereof, core fine particles, and toner base particles in an aqueous medium and then condensing the organosilicon compound.

The organosilicon compound can be added to and mixed with the aqueous medium by an arbitrary method.

The organosilicon compound may be added as it is, but it is preferably added after mixing with an aqueous medium and hydrolysis.

The reaction of the organosilicon compound is known to have a pH dependency, and in the hydrolysis reaction, the pH of the aqueous medium is preferably at least 2.0 and not more than 7.0, while in the condensation reaction, the pH of the aqueous medium is preferably at least 7.0 and not more than 12.0.

The pH of the aqueous medium or the mixed liquid may be adjusted with a well-known acid or alkali. Examples of the acid for pH adjustment are presented hereinbelow.

Hydrochloric acid, hydrobromic acid, iodic acid, perbromic acid, metaperiodic acid, permanganic acid, thiocyanic acid, sulfuric acid, nitric acid, phosphonic acid, phosphoric acid, diphosphoric acid, hexafluorophosphoric acid, tetrafluoroboric acid, tripolyphosphoric acid, aspartic acid, o-aminobenzoic acid, p-aminobenzoic acid, isonicotinic acid, oxaloacetic acid, citric acid, 2-glycerolphosphoric acid, glutamic acid, cyanoacetic acid, oxalic acid, trichloroacetic acid, o-nitrobenzoic acid, nitroacetic acid, picric acid, picolinic acid, pyruvic acid, fumaric acid, fluoroacetic acid, bromoacetic acid, o-bromobenzoic acid, maleic acid, malonic acid.

Examples of the base for pH adjustment are presented hereinbelow.

Alkali metal hydroxides such as potassium hydroxide, sodium hydroxide and lithium hydroxide and aqueous solutions thereof; alkali metal carbonates such as potassium carbonate, sodium carbonate, and lithium carbonate and aqueous solutions thereof; alkali metal sulfates such as potassium sulfate, sodium sulfate and lithium sulfate and aqueous solutions thereof; alkali metal phosphates such as potassium phosphate, sodium phosphate and lithium phosphate and aqueous solutions thereof; alkaline earth metal hydroxides such as calcium hydroxide and magnesium hydroxide and aqueous solutions thereof; ammonia; basic amino acids such as histidine, arginine and lysine and aqueous solutions thereof; and trishydroxymethylaminomethane. These acids and bases may be used singly or in combination of two or more thereof.

The core fine particles may be used as they are or after preparing an aqueous dispersion of the core fine particles in advance. Any mixing means may be used for preparing the mixed liquid.

A step of dispersing the core fine particles in the mixed liquid may be carried out. By uniformly dispersing the core fine particles, it is possible to attach the fine particles to the toner base particle in a more uniformly dispersed state.

The core fine particles can be dispersed using, for example, a high-pressure homogenizer, a rotary shearing homogenizer, an ultrasonic disperser and a high-pressure impact disperser.

Considered hereinbelow is a mechanism making it possible to control the embedding ratio of the fine particles to the toner base particle and the fixed attachment ratio of the fine particles to the toner base particle within the above ranges when the hydrolyzed organosilicon compound is used and the condensation reaction of the organosilicon compound is carried out.

At the time of condensation of the hydrolyzed organosilicon compound, the condensate of the organosilicon compound adheres to the surface of the core fine particle in a state where the stability to the aqueous medium is lowered.

The condensate of the organosilicon compound which has adhered to the surface of the core fine particle further undergoes a condensation reaction. As the condensation reaction progresses, the condensate of the organosilicon compound is rendered more hydrophobic due to the influence of the Si element.

That is, the surface of the core fine particle is coated with the hydrophobized condensate of the organosilicon compound.

It is difficult for the fine particles coated with the hydrophobized condensate of the organosilicon compound to be stably present in the aqueous medium, and the fine particles are embedded in the toner base particle, so that the surface thereof is no longer present in the aqueous medium. Further, at this time, since the condensate of the organosilicon compound acts as an adhesive at the interface between the fine particles and the toner base particle, the fine particles and the toner base particle are firmly and fixedly attached to each other.

Here, it is preferable to adjust the temperature during the condensation reaction to be at least the glass transition temperature (Tg) of the toner base particle. Specifically, it is preferable that the temperature during the condensation reaction be at least the glass transition temperature of the toner base particle and not more than the glass transition temperature +40° C., more preferably at least the glass transition temperature of the toner base particle and not more than the glass transition temperature+30° C.

With the following methods (1) and (2) which have been conventionally used, the condensate of the organosilicon compound cannot enter the interface between the toner base particle and the fine particle. Therefore, the fixed attachment ratio of the fine particles to the toner base particle is difficult to increase.

(1) A method of embedding the hydrophobized fine particles (for example, silica fine particles treated with hexamethyldisilazane) to the surface of the toner base particle by a mechanical impact force.

(2) A method of coating the surface of the toner base particle with the condensate of the organosilicon compound after embedding the hydrophobized fine particles by a mechanical impact force.

A method for producing the toner base particles is not particularly limited, and well-known suspension polymerization method, dissolution suspension method, emulsion aggregation method, pulverization method, and the like can be used.

When the toner base particles are produced in an aqueous medium, the toner base particles may be used directly as an aqueous dispersion, or may be redispersed in an aqueous medium after washing, filtration and drying.

When the toner base particles are produced by a dry method, the toner base particles can be dispersed in an aqueous medium by a known method. In order to disperse the toner base particles in an aqueous medium, it is preferable that the aqueous medium include a dispersion stabilizer.

Meanwhile, an example of a second production method involves preparing a mixed liquid including at least one of an organosilicon compound represented by Formula (1) and an organosilicon compound represented by Formula (2), or a hydrolyzate thereof, core fine particles, and a precursor of the toner base particles, and then condensing the organosilicon compound.

Examples of the precursor of the toner base particle include those including a polymerizable monomer capable of forming a binder resin.

The polymerization of the precursor of the toner base particle and the condensation of the organosilicon compound may be carried out simultaneously or separately.

When such a production method is used, the core fine particle can be coated with the condensate of the organosilicon compound at the same time as the fine particles are provided to the surface of the toner base particle.

Hereinafter, a method for producing toner base particles by using the suspension polymerization method will be described.

First, a polymerizable monomer capable of forming a binder resin and, if necessary, various materials are mixed and dissolved or dispersed using a disperser to prepare a polymerizable monomer composition.

Examples of the various materials include a colorant, a release agent, a charge control agent, a polymerization initiator, a chain transfer agent, and the like.

Examples of the disperser include a homogenizer, a ball mill, a colloid mill, and an ultrasonic disperser.

Subsequently, the polymerizable monomer composition is placed in an aqueous medium including poorly water-soluble inorganic fine particles, and droplets of the polymerizable monomer composition is prepared by using a high-speed disperser such as a high-speed stirrer and an ultrasonic disperser (granulation step).

Thereafter, polymerizable monomer in the droplets is polymerized to obtain toner base particles (polymerization step).

The polymerization initiator may be mixed at the time of preparing the polymerizable monomer composition or may be mixed in the polymerizable monomer composition just before droplets are formed in the aqueous medium.

Further, the polymerization initiator can also be added in a state of being dissolved, if necessary, in the polymerizable monomer or other solvent during granulation of the droplets or after completion of granulation, that is, immediately before the start of the polymerization reaction.

After obtaining the resin particles by polymerizing the polymerizable monomer, solvent removal treatment may be carried out, as necessary, to obtain a dispersion liquid of the toner base particles.

The constituent materials of the toner base particle will be described hereinbelow.

The binder resin constituting the toner base particle can be exemplified by the following resins or polymers.

Vinyl resins, polyester resins, polyamide resins, furan resins, epoxy resins, xylene resins, and silicone resins.

Among them, vinyl resins are preferable. Incidentally, examples of the vinyl resin include polymers of the following monomers or copolymers thereof. Among them, a copolymer of a styrene-based monomer and an unsaturated carboxylic acid ester is preferable.

Styrene monomers such as styrene and α-methylstyrene; unsaturated carboxylic acid esters such as methyl acrylate, butyl acrylate, methyl methacrylate, 2-hydroxyethyl methacrylate, t-butyl methacrylate and 2-ethylhexyl methacrylate; unsaturated carboxylic acids such as acrylic acid and methacrylic acid; unsaturated dicarboxylic acids such as maleic acid; unsaturated dicarboxylic acid anhydrides such as maleic anhydride; nitrile-based vinyl monomers such as acrylonitrile; halogen-containing vinyl monomers such as vinyl chloride; and nitro vinyl monomers such as nitrostyrene.

The following black pigments, yellow pigments, magenta pigments, cyan pigments and the like can be used as the colorant.

Examples of the black pigments include carbon black and the like.

Examples of the yellow pigments include monoazo compounds; disazo compounds; condensed azo compounds; isoindolinone compounds; isoindoline compounds; benzimidazolone compounds; anthraquinone compounds; azo metal complexes; methine compounds; and allylamide compounds. Specific examples include C. I. Pigment Yellow 74, 93, 95, 109, 111, 128, 155, 174, 180, 185, and the like.

Examples of the magenta pigments include monoazo compounds; condensed azo compounds; diketopyrrolopyrrole compounds; anthraquinone compounds; quinacridone compounds; basic dye lake compounds; naphthol compounds: benzimidazolone compounds; thioindigo compounds; perylene compounds. Specific examples include C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, 269, C. I. Pigment Violet 19 and the like.

Examples of the cyan pigments include copper phthalocyanine compounds and derivatives thereof, anthraquinone compounds, and basic dye lake compound. Specific examples include C. I. Pigment Blue 1, 7, 15, 15:1, 15:2, 15:3, 15:4, 60, 62, 66.

In addition to the pigment, various dyes conventionally known as colorants may be used in combination.

The content of the colorant is preferably at least 1.0 part by mass and not more than 20.0 parts by mass with respect to 100 parts by mass of the binder resin.

It is also possible to make magnetic toner by including a magnetic body in the toner. In this case, the magnetic body may serve as a colorant. Examples of the magnetic body include iron oxide typified by magnetite, hematite, ferrite, and the like; metals typified by iron, cobalt, nickel, and the like, alloys of these metals with a metal such as aluminum, cobalt, copper, lead, magnesium, tin, zinc, antimony, beryllium, bismuth, cadmium, calcium, manganese, selenium, titanium, tungsten, vanadium, and mixtures thereof.

Examples of the release agent are presented hereinbelow.

Esters of monohydric alcohols and aliphatic monocarboxylic acids, or esters of monovalent carboxylic acids and aliphatic monoalcohols, such as behenyl behenate, stearyl stearate, palmityl palmitate; esters of dihydric alcohols and aliphatic monocarboxylic acids, or esters of divalent carboxylic acids and aliphatic monoalcohols, such as dibehenyl sebacate and hexanediol dibehenate; esters of trihydric alcohols and aliphatic monocarboxylic acids, or esters or trivalent carboxylic acids and aliphatic monoalcohols, such as glycerin tribehenate; esters of tetrahydric alcohols and aliphatic monocarboxylic acids, or esters or tetravalent carboxylic acids and aliphatic monoalcohols, such as pentaerythritol tetrastearate and pentaerythritol tetrapalmitate; esters of hexahydric alcohols and aliphatic monocarboxylic acids, or esters or hexavalent carboxylic acids and aliphatic monoalcohols, such as dipentaerythritol hexastearate and dipentaerythritol hexapalmitate; esters of polyhydric alcohols and aliphatic monocarboxylic acids, or esters or polyvalent carboxylic acids and aliphatic monoalcohols, such as polyglycerin behenate; natural ester waxes such as carnauba wax and rice wax; petroleum waxes such as paraffin wax, microcrystalline wax and petrolatum and derivatives thereof; hydrocarbon waxes obtained by the Fischer-Tropsch process and derivatives thereof; polyolefin waxes such as polyethylene wax and polypropylene wax and derivatives thereof; higher aliphatic alcohols; fatty acids such as stearic acid and palmitic acid; and acid amide waxes.

The content of the release agent is preferably at least 0.5 parts by mass and not more than 20.0 parts by mass with respect to 100 parts by mass of the binder resin.

Various organic or inorganic fine particles may be externally added to the toner particles to such an extent that the abovementioned characteristics or the abovementioned effects are not impaired. Examples of organic or inorganic fine particles include following materials.

(1) Flowability-imparting agent: silica, alumina, titanium oxide, carbon black, and carbon fluoride.

(2) Abrasive: metal oxides (for example, strontium titanate, cerium oxide, alumina, magnesium oxide, and chromium oxide), nitrides (for example, silicon nitride), carbides (for example, silicon carbide), metal salts (for example, calcium sulfate, barium sulfate, and calcium carbonate).

(3) Lubricant: fluorine resin powder (for example, vinylidene fluoride and polytetrafluoroethylene), fatty acid metal salts (for example, zinc stearate and calcium stearate).

(4) Charge control particles: metal oxides (for example, tin oxide, titanium oxide, zinc oxide, silica, and alumina) and carbon black.

The organic or inorganic fine particles can also be hydrophobized. Examples of the treatment agents for hydrophobic treatment of organic or inorganic fine particles include unmodified silicone varnishes, various modified silicone varnishes, unmodified silicone oils, various modified silicone oils, silane compounds, silane coupling agents, other organosilicon compounds, and organotitanium compounds. These treatment agents may be used alone or in combination.

Methods for measuring the respective physical property values defined in the present invention are described hereinbelow.

<Method of Wettability Testing with Respect to Methanol/Water Mixed Solvent>

The wettability test of the toner with respect to the mixed solvent of methanol and water is carried out by using a powder wettability tester "WET-100P" (produced by Rhesca Co., Ltd.) under the following conditions and according to the following procedure, and calculations are performed from the obtained methanol drip permeability curve.

A spindle-type rotor coated with a fluororesin and having a length of 25 mm and a maximum barrel diameter of 8 mm is placed in a cylindrical glass container having a diameter of 5 cm and a thickness of 1.75 mm.

A total of 60.0 ml of distilled water is placed in the cylindrical glass container and treated for 5 min with an ultrasonic disperser in order to remove air bubbles and the like. A total of 0.1 g of the toner as a specimen is accurately weighed and added thereto to prepare a measurement sample liquid.

Methanol is continuously added at a dropping rate of 0.8 ml/min to the sample liquid for measurement through the powder wettability tester while stirring the spindle-type rotor in the cylindrical glass container at a speed of 300 rpm by using a magnetic stirrer.

The transmittance is measured with light having a wavelength of 780 nm, and a methanol drip permeability curve is plotted. From the obtained methanol drip permeability curve, a methanol concentration (TA) when the transmittance shows 50% is read.

The methanol concentration (TA; % by volume) is a value calculated from [(the volume of methanol present in the cylindrical glass container)/(the volume of the mixture of methanol and water present in the cylindrical glass container)×100].

<Method for Measuring Weight Average Particle Diameter (D4) of Toner Base Particle>

The weight-average particle diameter (D4) is calculated in the following manner.

A precision particle size distribution measuring device "Coulter Counter Multisizer 3" (registered trademark, produced by Beckman Coulter, Inc.) based on a pore electrical resistance method and including a 100 m aperture tube is used as a measuring device. The dedicated software "Beckman Coulter Multisizer 3 Version 3.51" (produced by Beckman Coulter, Inc.) is used for setting measurement conditions and performing analysis of measurement data. The measurement is performed at a number of effective measurement channels of 25,000.

A solution obtained by dissolving reagent grade sodium chloride in ion-exchanged water to a concentration of 1.0%, for example, "ISOTON II" (produced by Beckman Coulter, Inc.) can be used as the aqueous electrolytic solution to be used in the measurement.

The dedicated software is set as described hereinbelow before the measurement and analysis are performed.

In the "STANDARD MEASUREMENT METHOD (SOMME) CHANGE" screen of the dedicated software, the total count number of a control mode is set to 50,000 particles, the number of measurement cycles is set to 1, and a value obtained using "STANDARD PARTICLES 10.0 μm" (produced by Beckman Coulter, Inc.) is set as a Kd value.

A threshold and a noise level are set automatically by pressing the "THRESHOLD/NOISE LEVEL MEASUREMENT BUTTON". Further, a current is set to 1600 μA, a gain is set to 2, an electrolytic solution is set to ISOTON II, and a check mark is placed in "FLUSH OF APERTURE TUBE AFTER MEASUREMENT" check box.

At the "PULSE-TO-PARTICLE DIAMETER CONVERSION SETTING" screen of the dedicated software, a bin interval is set to a logarithmic particle diameter, the number of particle diameter bins is set to 256, and the particle diameter range is set to a range from 2 μm to 60 μm.

A specific measurement method is described below.

(1) About 200.0 ml of the aqueous electrolytic solution is poured into a 250-mL round-bottom beaker designed specifically for Multisizer 3. The beaker is set in a sample stand, and the electrolytic solution is stirred with a stirrer rod at 24 rotations/sec in a counterclockwise direction. Then, dirt and air bubbles in the aperture tube are removed by the "APERTURE FLUSH" function of the dedicated software.

(2) About 30 mL of the aqueous electrolytic solution is poured into a 100-mL flat-bottom beaker. Then, about 0.3 mL of a diluted solution prepared by diluting "Contaminon N" (a 10% aqueous solution of a neutral detergent for washing precision measuring devices; contains a nonionic surfactant, an anionic surfactant, and an organic builder, and has a pH of 7; produced by Wako Pure Chemical Industries, Ltd.) with ion-exchanged water by a factor of 3 in terms of mass is added as a dispersant to the aqueous electrolytic solution.

(3) An ultrasonic disperser "Ultrasonic Dispersion System Tetra 150" (produced by Nikkaki Bios Co., Ltd.) which has an electrical output of 120 W and in which two oscillators having an oscillating frequency of 50 kHz are installed with a phase shift of 180 degrees is prepared. A total of 3.3 L of ion-exchanged water is poured into the water tank of the ultrasonic disperser, and about 2.0 mL of the Contaminon N is added to the water tank.

(4) The beaker in clause (2) above is set in the beaker fixing hole of the ultrasonic disperser, and the ultrasonic disperser is actuated. Then, the height position of the beaker is adjusted to realize a maximum resonant state of the liquid level of the aqueous electrolytic solution in the beaker.

(5) About 10 mg of the toner base particles is added by small portions and dispersed in the aqueous electrolytic solution in the beaker of clause (4) above while irradiating the aqueous electrolytic solution with ultrasonic waves. Then, the ultrasonic dispersion treatment is further continued for 60 sec. During the ultrasonic dispersion, the temperature of water in the water tank is appropriately adjusted to be in the range from at least 10° C. to not more than 40° C.

(6) The aqueous electrolytic solution of clause (5) above, in which the toner base particles have been dispersed, is added dropwise with a pipette into the round-bottom beaker of clause (1) above which has been placed in the sample stand, and the measurement concentration is adjusted to 5%. Measurements are then performed until the number of measured particles becomes 50,000.

(7) The measured data are analyzed with the dedicated software included with the apparatus, and the weight-average particle diameter (D4) is calculated. The "AVERAGE DIAMETER" on the "ANALYSIS/VOLUME STATISTICS (ARITHMETIC AVERAGE)" screen when the dedicated software is set to graph/vol % is the weight-average particle diameter (D4).

<Method for Measuring Glass Transition Temperature (Tg) of Toner Base Particle>

The glass transition temperature (Tg) of the toner base particle is measured using a differential scanning calorimeter (referred to hereinbelow as "DSC").

The glass transition temperature is measured with the DSC according to JIS K 7121 (international standard ASTM D 3418-82).

In the measurement, "Q1000" (produced by TA Instruments.) is used, the melting points of indium and zinc are used for temperature correction of the detection unit of the apparatus, and heat of fusion of indium is used for correction of the calorific value.

Specifically, 10 mg of the sample is accurately weighed and placed in an aluminum pan, and an empty aluminum pan is used as a reference.

In a first temperature rise process, the measurement is performed by raising the temperature of the measurement sample from 20° C. to 200° C. at a ramp rate of 10° C./min. Then, the temperature is held for 10 min at 200° C., and the measurement is performed while carrying out a cooling process in which the temperature is lowered from 200° C. to 20° C. at a rate of 10° C./min. After holding the temperature for 10 min at 20° C., in the second temperature rise process, the measurement is performed while raising the temperature again from 20° C. to 200° C. at a ramp down rate of 10° C./min.

The glass transition temperature is the intermediate glass transition temperature. The temperature at the intersection of a straight line which is equidistant, in the ordinate direction, from the straight lines, which are extensions of base lines on the low-temperature side and the high-temperature side of the stepwise change of the glass transition temperature, and the curve of the stepwise change portion in the DSC curve in the second temperature rise process obtained under the abovementioned measurement conditions is taken as the glass transition temperature (Tg).

In the case of preparing toner base particles in an aqueous medium or the like, DSC measurement is performed after a part thereof is sampled and the parts other than the toner base particles are washed and dried.

<Method for Calculating Coverage Ratio of Fine Particles to Toner Base Particle Surface>

The coverage state of the fine particles on the surface of the toner particle is observed using a scanning electron microscope (SEM) "JSM-7800F" (produced by JEOL Ltd.).

Figure 3A:
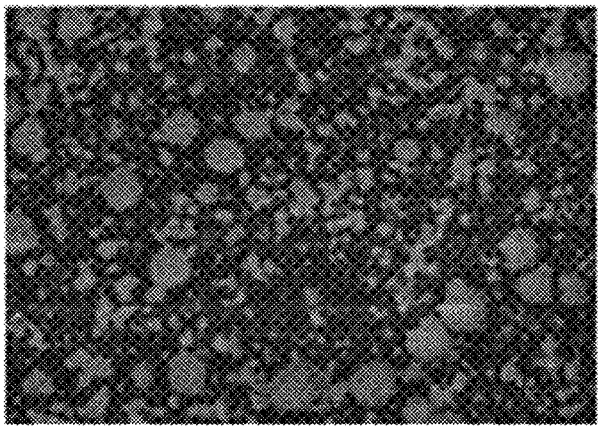
FIG. 3A is an example of a backscattered electron image of a toner particle (a photograph substituted for a drawing)

FIG. 3A is an example of a backscattered electron image of a toner captured using a scanning electron microscope, and FIG. 1 is a scanning electron microphotograph of the toner.

The image capturing conditions of the scanning electron microscope "JSM-7800F" are as follows.

| | |
|---|---|
| Observation mode | GB |
| Incident voltage | 1.0 [kV] |
| WD (working distance) | 2 [mm] |
| Detector | UED |
| Scan mode | CF1 |

One image is captured for one toner particle. Image capturing is performed for 10 toner particles, that is, 10 images are captured.

Next, using the image processing analyzer (LUZEX AP, produced by Nireco Corporation), the coverage ratio is calculated by the following procedure.

(1) "FILE" is selected in the "INPUT/OUTPUT" tab, and a file to be image-processed is selected.

(2) A mask size "3×3" is selected from "SPATIAL FILTER" in a "GRAY IMAGE PROCESSING" tab. In addition, the linear "AVERAGING PROCESSING" is performed twice.

(3) A portion derived from the fine particles in the image is selected by "MANUAL CORRECTION" in the "BINARY IMAGE PROCESSING" tab.

(4) "MEASUREMENT" is selected in the "BINARY IMAGE PROCESSING" tab. The numerical value of the area ratio is taken as the coverage ratio of the image.

The above operations (1) to (4) are carried out for five images, and the average value thereof is taken as the coverage ratio of the fine particles to the surface of the toner base particle. Hereinafter, it is also referred to as "coverage ratio of fine particles", and the unit is "% by area".

<Method for Calculating Coverage Ratio by Condensate of Organosilicon Compound to Toner Base Particle Surface Excluding Fine Particles>

In order to calculate the coverage ratio, a backscattered electron image taken with a scanning electron microscope (SEM) "JSM-7800F" (produced by JEOL Ltd.) is used.

The image capturing conditions are the same as in the "Method for Calculating Coverage Ratio of Fine Particles to Toner Base Particle Surface".

The coverage ratio of the condensate of the organosilicon compound on the toner base particle surface excluding the fine particles is calculated in the following manner by using the obtained backscattered electron image.

Using the image processing analyzer (LUZEX AP, produced by Nireco Corporation), the coverage ratio is calculated by the following procedure.

(1) "FILE" is selected in the "INPUT/OUTPUT" tab, and a file to be image-processed is selected.

(2) A mask size "3×3" is selected from "SPATIAL FILTER" in a "GRAY IMAGE PROCESSING" tab. In addition, the linear "AVERAGING PROCESSING" is performed twice.

Figure 3B:
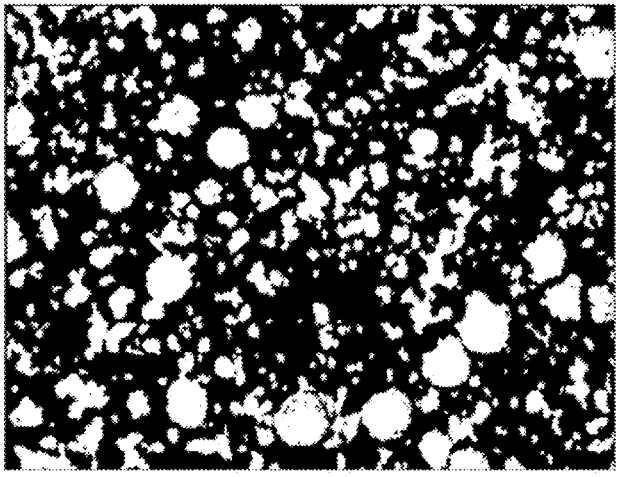
FIG. 3B is an image after binarization processing of the image shown in FIG. 3A.

(3) "I" is changed in the "BINARIZATION DETERMINATION" in the "BINARY IMAGE PROCESSING" tab, and a portion derived from the organosilicon condensate in the image is selected and binarized. FIG. 3B is an example of an image after binarization processing.

(4) "MEASUREMENT" in the "BINARY IMAGE PROCESSING" tab is selected. The numerical value of the area ratio is taken as the coverage ratio of the image.

The above operations (1) to (4) are carried out for five images, and the average value thereof is taken as the coverage ratio of the fine particles and the condensate of the organosilicon compound to the toner base particle surface. Hereinafter, it is also called "total coverage ratio", and the unit is "% by area".

Using the "coverage ratio (% by area) of the fine particles" calculated by the method of calculating the coverage ratio of the fine particles to the toner base particle surface and "the total coverage ratio (% by area)", the coverage ratio by the condensate of an organosilicon compound to the toner base particle surface excluding the fine particles "coverage ratio A (% by area)" is calculated by the following formula.

"Coverage ratio $A$"=("total coverage ratio"−"coverage ratio of fine particles")/(100−"coverage ratio of fine particles")

<Method for Calculating Embedding Ratio of Fine Particles to Toner Base Particle>

The embedding ratio of fine particles to a toner base particle is calculated from cross-sectional observation of the toner base particle using a transmission electron microscope (TEM).

After thoroughly dispersing the toner in a visible light-curable enclosing resin (trade name: D-800, produced by Toagosei Co., Ltd.), the toner is irradiated with visible light by using a light illuminating device (trade name: LUXSPOT II, produced by JEOL Ltd.) to cure the visible light-curable enclosing resin and obtain a cured product. From the resulting cured product, a flaky sample is cut out using a microtome equipped with a diamond blade. A cross section of one toner particle is observed by using a transmission electron microscope (TEM) (trade name: JEM 2800, produced by JEOL Ltd.) at an acceleration voltage of 200 kV and a magnification ratio of 100,000 times.

From the obtained cross-sectional image, calculation is performed according to the following procedure (FIG. 2 is a diagram for explaining the calculation procedure of the embedding ratio of fine particles from a cross-sectional image).

(1) The surface of the toner base particle is regarded as a straight line, and a line which is parallel to the surface of the toner base particle and passes through the highest point of a portion (protrusion) of the fine particles protruding from the toner base particle is drawn. Although the surface of the toner base particle enlarged at a magnification of 100,000 times is a somewhat uneven line, it is observed to be almost linear. This is why the toner base particle is regarded as a straight line.

(2) A line which is parallel to the surface of the toner base particle and passes through the lowest point of the deepest portion of the embedded fine particle in the toner base particle is drawn.

(3) The distance between the two straight lines obtained in (1) and (2) is taken as a fine particle diameter "R".

(4) Next, the distance between the line parallel to the surface of the toner base particle and the line obtained in the (2) is taken as a fine particle embedding length "r".

(5) Then, (r/R×100) is determined.

This operation is carried out for 100 particles, and the average value of all the values is taken as the embedding ratio [%] of the fine particles to the toner base particle.

<Method for Calculating Fixed Attachment Ratio of Fine Particles to Toner Base Particle>

The fixed attachment ratio of the fine particles to the toner base particle is calculated from the initial amount of fine particles in the toner and the amount of fine particles remaining after removing the fine particles which have not been fixedly attached to the surface of the toner base particle by the following method.

A total of 160.0 g of sucrose is added to 100.0 mL of ion-exchanged water and dissolved while warming to prepare an aqueous sucrose solution. A solution prepared by adding 31.0 mL of the sucrose aqueous solution and 6.0 mL of a nonionic surfactant Contaminon N (trade name, produced by Wako Pure Chemical Industries, Ltd.) is placed in a sealable 50 mL polyethylene sample bottle, 0.5 g of the sample is added, and the sealed container is gently shaken and stirred and then allowed to stand for 1 h.

An ultrasonic disperser UH-50 (trade name, produced by SMT Corporation) is used, the output memory is set to 10, and dispersion is performed for 20 min. The dispersed sample is promptly transferred to a container for centrifugal separation.

The sample transferred to the container for centrifugal separation is centrifugally separated in a high-speed cooled centrifuge H-9R (trade name, produced by Kokusan Co., Ltd.) under the conditions of a set temperature of 20° C., an acceleration/deceleration set to the shortest time, a rotation speed of 3500 rpm, and a rotation time of 30 min. The toner separated at the top is recovered, filtered with a vacuum filter, and dried in a dryer for 1 h or more.

The fixed attachment ratio is calculated by the following formula.

$$\text{Fixed attachment ratio}[\%]=\{1-(P1-P2)/P1\}\times 100$$

In Formula, P1 is the amount of fine particles (% by mass) of the initial toner, and P2 is the amount of fine particles (% by mass) in the toner after removal of fine particles which have not been fixedly attached to the surface of the toner base particle in the above procedure.

The amount of fine particles in the toner is calculated by drawing a calibration curve from the element intensity derived from the fine particles of the toner obtained by wavelength dispersive X-ray fluorescence analysis.

Measurement of fluorescent X-ray of each element is conducted in accordance with JIS K 0119-1969, specifically as follows.

A wavelength dispersive fluorescent X-ray analyzer "Axios" (produced by PANalytical) and dedicated software "SuperQ ver. 4.0 F" (produced by PANalytical) for performing measurement condition setting and measurement data analysis are used as the measuring device.

Rh is used as the anode of the X-ray tube, the measurement atmosphere is vacuum, the measurement diameter (collimator mask diameter) is 27 mm, and the measurement time is 10 sec. In addition, a proportional counter (PC) is used to measure light elements and a scintillation counter (SC) is used to measure heavy elements.

A pellet produced by placing about 4 g of a toner in a dedicated pressing aluminum ring, flattening and pressing for 60 sec at 20 MPa by using a tablet molding compressor "BRE-32" (produced by Maekawa Testing Machine MFG. Co., Ltd.) to a thickness of about 2 mm and a diameter of about 39 mm is used as a measurement sample.

Measurement is carried out under the abovementioned conditions, elements are identified on the basis of the obtained X-ray peak position, and the concentration thereof is calculated from the count rate (unit: cps) which is the number of X-ray photons per unit time.

<Method for Measuring Number Average Particle Diameter of Core Fine Particles>

The number average particle diameter of the core fine particles is measured using Zetasizer Nano-ZS (produced by Malvem Instruments Ltd), and an aqueous dispersion having a core fine particle concentration of 1.0% by mass is measured.

The measurement conditions are as follows.

Cell: Quartz Glass Cell
Dispersant: Water (Dispersant RI: 1.330)
Temperature: 25° C.
Material RI: 1.60
Result Calculation: General Purpose

EXAMPLES

Hereinafter, the present invention will be specifically described with reference to Examples and Comparative Examples, but the present invention is not limited thereto. "Parts" and "%" of each material in the Examples and Comparative Examples are all on a mass basis unless otherwise specified.

Production Example of Organosilicon Compound Solution 1

Ion-exchanged water 70.0 parts
Methyltrimethoxysilane 30.0 parts

The aforementioned materials were weighed in a 200 mL beaker and the pH was adjusted to 3.5 with 1 mol/L hydrochloric acid. Stirring was then conducted for 1 h while heating to 60° C. with a water bath, thereby preparing an organosilicon compound solution 1. Organosilicon compound solutions 2 to 5 were prepared in the same manner except that the type and amount of the organosilicon compound were changed as shown in Table 1 below.

TABLE 1

| | Organosilicon compound | Parts |
|---|---|---|
| Organosilicon compound solution 1 | Methyltriethoxysilane | 30.0 |
| Organosilicon compound solution 2 | Ethyltrimethoxysilane | 30.0 |
| Organosilicon compound solution 3 | Ethyltriethoxysilane | 30.0 |
| Organosilicon compound solution 4 | Vinyltriethoxysilane | 30.0 |
| Organosilicon compound solution 5 | Dimethyldiethoxysilane | 30.0 |

Production Example of Toner Base Particle Dispersion Liquid 1

Production Example of Aqueous Medium 1

A total of 390.0 parts of ion-exchanged water and 14.0 parts of sodium phosphate (dodecahydrate) (produced by Rasa Industries, Ltd.) were placed in a reaction vessel and kept for 1.0 h at 65° C. while purging with nitrogen.

An aqueous solution of calcium chloride prepared by dissolving 9.2 parts of calcium chloride (dihydrate) in 10.0 parts of ion-exchanged water was charged in a batch mode, while stirring at 12,000 rpm by using a T. K. Homomixer (produced by Tokushu Kika Kogyo Co., Ltd.), to prepare an aqueous medium including a dispersion stabilizer.

Further, 10% hydrochloric acid was added to the aqueous medium, and the pH was adjusted to 6.0 to obtain aqueous medium 1.

Production Example of Polymerizable Monomer Composition 1

| | |
|---|---|
| Styrene | 60.0 parts |
| Colorant (C.I. Pigment Blue 15:3) | 6.5 parts |

The aforementioned materials were charged into an attritor (produced by Nippon Coke & Engineering Co., Ltd.) and further dispersed at 220 rpm for 5.0 h by using zirconia particles having a diameter of 1.7 mm to prepare a dispersion 1 in which a colorant was dispersed.

The following materials were added to the dispersion 1.

| | |
|---|---|
| Styrene | 20.0 parts |
| n-Butyl acrylate | 20.0 parts |
| Polyester resin (condensate of bisphenol A propylene oxide 2 mol adduct/terephthalic acid/trimellitic acid, glass transition temperature: 75° C.) | 5.0 parts |
| Fischer-Tropsch wax (melting point: 78° C.) | 7.0 parts |

The mixture was kept at 65° C. and homogeneously dissolved and dispersed at 500 rpm using a T. K. Homomixer to prepare a polymerizable monomer composition 1.

(Granulation Step)

The polymerizable monomer composition 1 was charged into the aqueous medium 1 while maintaining the temperature of the aqueous medium 1 at 70° C. and the rotation speed of the stirring device at 12,000 rpm, and 9.0 parts of t-butylperoxypivalate was added as a polymerization initiator. The mixture was granulated for 10 min while maintaining the rotation speed of the stirring device at 12,000 rpm.

(Polymerization Step)

The high-speed stirring device was replaced with a stirrer equipped with a propeller stirring blade, and polymerization was conducted for 5.0 h while stirring at 150 rpm and keeping the temperature at 70° C. A polymerization reaction was further performed by raising the temperature to 85° C. and heating for 2.0 h to obtain a toner base particle dispersion liquid 1.

The weight average particle diameter (D4) of the toner base particles in the toner base particle dispersion liquid 1 was 6.7 m, and the glass transition temperature (Tg) thereof was 56° C.

Further, ion-exchanged water was added to the toner base particle dispersion liquid 1 to adjust the concentration of the toner base particles in the dispersion to 20.0%.

Production Example of Toner Base Particle Dispersion Liquid 2

Production Example of Resin Fine Particle Dispersion

The following materials were weighed and mixed and dissolved.

| | |
|---|---|
| Styrene | 82.6 parts |
| n-Butyl acrylate | 9.2 parts |

-continued

| | |
|---|---|
| Acrylic acid | 1.3 parts |
| Hexanediol acrylate | 0.4 parts |
| n-Lauryl mercaptan | 3.2 parts |

A 10% aqueous solution of Neogen RK (produced by DKS Co. Ltd.) was added to the obtained solution and dispersed therein. An aqueous solution prepared by dissolving 0.15 parts of potassium persulfate in 10.0 parts of ion-exchanged water was added while gently stirring for 10 min. After nitrogen substitution, emulsion polymerization was carried out for 6.0 h at a temperature of 70° C. After completion of the polymerization, the reaction solution was cooled to room temperature, and ion-exchanged water was added to obtain a resin particle dispersion liquid having a solid fraction concentration of 12.5% by mass and a volume-based median diameter of 0.2 μm.

Production Example of Wax Dispersion

The following materials were weighed and mixed.

| | |
|---|---|
| Ester wax (melting point: 70° C.) | 100.0 parts |
| Neogen RK (produced by DKS Co., Ltd.) | 15.0 parts |
| Ion-exchanged water | 385.0 parts |

The materials were dispersed for 1 h by using a wet jet mill JN 100 (produced by Jokoh Co., Ltd.) to obtain a wax dispersion. The solid fraction concentration of the wax in the wax particle dispersion was 20.0%.

Production Example of Colorant Dispersion

The following materials were weighed and mixed.

| | |
|---|---|
| Colorant (C.I. Pigment Blue 15:3) | 100.0 parts |
| Neogen RK (produced by DKS Co., Ltd.) | 15.0 parts |
| Ion-exchanged water | 885.0 parts |

The materials were dispersed for 1 h by using a wet jet mill JN 100 (produced by Jokoh Co., Ltd.) to obtain a colorant dispersion.

| | |
|---|---|
| Resin particle dispersion | 160.0 parts |
| Wax dispersion | 10.0 parts |
| Colorant dispersion | 10.0 parts |
| Magnesium sulfate | 0.2 parts |

The aforementioned materials were dispersed using a homogenizer (ULTRA TURRAX T50, produced by IKA®-Werke GmbH & Co. Kg), and then heated to 65° C. under stirring.

After stirring at 65° C. for 1.0 h, observation with an optical microscope confirmed that aggregate particles having a number average particle diameter of 6.0 μm were formed.

After adding 2.2 parts of Neogen RK (produced by DKS Co. Ltd.), the temperature was raised to 80° C. and stirring was performed for 2.0 h to obtain fused spherical toner base particles.

After cooling and filtration, the filtered solids were washed with 720.0 parts of ion-exchanged water for 1.0 h under stirring. A solution including the toner base particles was filtered and dried using a vacuum dryer to obtain toner base particles 2. The weight average particle diameter (D4) of the toner base particles 2 was 7.1 μm, and the glass transition temperature (Tg) thereof was 58° C.

A total of 390.0 parts of ion-exchanged water and 14.0 parts of sodium phosphate (dodecahydrate) (produced by Rasa Industries, Ltd.) were placed in a container and kept at 65° C. for 1.0 h while purging with nitrogen.

An aqueous solution of calcium chloride prepared by dissolving 9.2 parts of calcium chloride (dihydrate) in 10.0 parts of ion-exchanged water was charged in a batch mode, while stirring at 12,000 rpm by using a T. K. Homomixer, to prepare an aqueous medium including a dispersion stabilizer.

Further, 10% hydrochloric acid was added to the aqueous medium, and the pH was adjusted to 6.0 to obtain aqueous medium 2.

A total of 100.0 parts of the toner base particles 2 was charged into the aqueous medium 2 and dispersed for 15 min while rotating at a temperature of 60° C. and 5000 rpm by using the T. K. Homomixer. Ion-exchanged water was added to adjust the concentration of the toner base particles in the dispersion to 20.0% and obtain a toner base particle dispersion liquid 2.

Production Example of Toner Base Particle Dispersion Liquid 3

A total of 660.0 parts of ion-exchanged water and 25.0 parts of a 48.5% aqueous solution of sodium dodecyl diphenyl ether disulfonate were mixed and stirred at 10,000 rpm by using the T. K. Homomixer to obtain an aqueous medium 3.

The following materials were charged into 500.0 parts of ethyl acetate and dissolved under rotation at 100 rpm in a propeller stirrer to prepare a solution

| | |
|---|---|
| Styrene/butyl acrylate copolymer (copolymerization mass ratio: 80/20) | 100.0 parts |
| Saturated polyester resin (condensate of terephthalic acid and bisphenol A propylene oxide 2 mol adduct) | 3.0 parts |
| Colorant (C.I. Pigment Blue 15:3) | 6.5 parts |
| Fischer-Tropsch wax (melting point: 78° C.) | 9.0 parts |

A total of 150.0 parts of the aqueous medium 3 was placed in a container and stirred at a rotation speed of 12,000 rpm by using the T. K. Homomixer. A total of 100.0 parts of the solution was added thereto, followed by mixing for 10 min to prepare an emulsified slurry.

Thereafter, 100.0 parts of the emulsified slurry was charged in a flask equipped with a degassing pipe, a stirrer, and a thermometer, and solvent removal was performed under reduced pressure for 12 h at 30° C. while stirring at a stirring peripheral speed of 20 m/min. Subsequent aging for 4 h at 45° C. produced a solvent-free slurry.

After filtering the solvent-free slurry under reduced pressure, 300.0 parts of ion-exchanged water was added to the obtained filter cake, followed by mixing and redispersing with the T. K. Homomixer (for 10 min at a rotation speed of 12,000 rpm) and then filtering.

The resulting filter cake was dried for 48 h at 45° C. in a dryer and sieved with a mesh size of 75 μm to obtain toner base particles 3. The toner base particles 3 had a weight average particle diameter (D4) of 6.9 μm and a glass transition temperature (Tg) of 55° C.

A total of 390.0 parts of ion-exchanged water and 14.0 parts of sodium phosphate (dodecahydrate) (produced by Rasa Industries, Ltd.) were placed in a container and kept at 65° C. for 1.0 h while purging with nitrogen.

An aqueous solution of calcium chloride prepared by dissolving 9.2 parts of calcium chloride (dihydrate) in 10.0 parts of ion-exchanged water was charged in a batch mode, while stirring at 12,000 rpm by using the T. K. Homomixer, to prepare an aqueous medium including a dispersion stabilizer.

Further, 10% hydrochloric acid was added to the aqueous medium, and the pH was adjusted to 6.0 to obtain an aqueous medium.

A total of 100.0 parts of the toner base particles 3 was charged into the obtained aqueous medium and dispersed for 15 min while rotating at a temperature of 60° C. and 5000 rpm by using the T. K. Homomixer. Ion-exchanged water was added to adjust the concentration of the toner base particles in the dispersion to 20.0% and obtain a toner base particle dispersion liquid 3.

Production Example of Toner Base Particle Dispersion Liquid 4

The following materials were charged into a reaction vessel equipped with a cooling tube, a stirrer, and a nitrogen introduction tube.

| | |
|---|---|
| Terephthalic acid | 29.0 parts |
| Polyoxypropylene (2.2)-2,2-bis (4-hydroxyphenyl) propane | 80.0 parts |
| Titanium dihydroxybis (triethanolaminate) | 0.1 parts |

Thereafter, the mixture was heated to 200° C. and reacted for 9 h while introducing nitrogen and removing the generated water. Further, 5.8 parts of trimellitic anhydride was added, and the mixture was heated to 170° C. and reacted for 3 h to synthesize a polyester resin.

Also,

| | |
|---|---|
| Low-density polyethylene (melting point: 100° C.) | 20.0 parts |
| Styrene | 64.0 parts |
| n-Butyl acrylate | 13.5 parts |
| Acrylonitrile | 2.5 parts |

were charged in an autoclave, the interior of the system was purged with nitrogen, the temperature was raised, and the system was kept at 180° C. under stirring.

A total of 50.0 parts of a xylene solution of 2.0% t-butyl hydroperoxide was continuously added dropwise over 4.5 h to the system, the solvent was separated and removed after cooling, and the copolymer was grafted to polyethylene thereby obtaining a graft polymer.

| | |
|---|---|
| Polyester resin | 100.0 parts |
| Paraffin wax (melting point: 75° C.) | 5.0 parts |
| Graft polymer | 5.0 parts |
| C.I. Pigment Blue 15:3 | 5.0 parts |

The above materials were mixed thoroughly with an FM mixer (FM-75 type, produced by Nippon Coke & Engineering Co., Ltd.), and then melt-kneaded with a twin-screw kneader (PCM-30 type, produced by Ikegai Ironworks Corp.) set at a temperature of 100° C.

The obtained kneaded product was cooled and coarsely pulverized to 1 mm or less with a hammer mill to obtain a coarsely pulverized product. Next, finely pulverized product of about 5 μm was obtained from the coarsely pulverized product by using a turbo mill (T-250: RSS rotor/SNB liner) produced by Turbo Kogyo Co., Ltd.

Thereafter, the fine powder and the coarse powder were further cut using a multi-division classifier utilizing the Coanda effect to obtain toner base particles 4.

The weight average particle diameter (D4) of the toner base particles 4 was 6.4 μm, and the glass transition temperature (Tg) was 59° C.

A total of 390.0 parts of ion-exchanged water and 14.0 parts of sodium phosphate (dodecahydrate) (produced by Rasa Industries, Ltd.) were placed in a container and kept at 65° C. for 1.0 h while purging with nitrogen.

An aqueous solution of calcium chloride prepared by dissolving 9.2 parts of calcium chloride (dihydrate) in 10.0 parts of ion-exchanged water was charged in a batch mode, while stirring at 12,000 rpm by using the T. K. Homomixer, to prepare an aqueous medium including a dispersion stabilizer.

Further, 10% hydrochloric acid was added to the aqueous medium, and the pH was adjusted to 6.0 to obtain an aqueous medium 4.

A total of 200.0 parts of the toner base particles 4 was charged into the aqueous medium 4 and dispersed for 15 min while rotating at a temperature of 60° C. and 5000 rpm by using the T. K. Homomixer. Ion-exchanged water was added to adjust the concentration of the toner base particles in the dispersion to 20.0% and obtain a toner base particle dispersion liquid 4.

Production Example of Toner Particle 1

(Step 1)

The following materials were weighed in a reaction container and mixed using a propeller stirring blade.

| | |
|---|---|
| Organosilicon compound solution 1 | 13.3 parts |
| Core fine particles (silica fine particles produced by the water glass method, number average particle diameter 32 nm) | 1.0 part |
| Toner base particle dispersion liquid 1 | 500.0 parts |

Next, the pH of the resultant mixed liquid was adjusted to 5.5, and the temperature of the mixed liquid was brought to 70° C. and then kept for 1 h while mixing with a propeller stirring blade.

(Step 2)

Thereafter, the pH was adjusted to 9.5 by using a 1 mol/L NaOH aqueous solution, and the temperature was kept at 70° C. for 4 h under stirring. Thereafter, the pH was adjusted to 1.5 with 1 mol/L hydrochloric acid, and the system was stirred for 1 h and then filtered, while washing with ion-exchanged water, to obtain toner particles 1 in which the fine particles were present on the surface of the toner base particles.

Production Example of Toner Particles 2 to 15

Toner particles 2 to 15 were prepared in the same manner as in the Production Example of Toner Particles 1, except for changing, as shown in Table 2, the type and addition amount of the organosilicon compound solution, the type and addition amount of the core fine particles and the type of the toner base particle dispersion liquid in the Production Example of Toner Particles 1.

The obtained toner particles 1 to 15 were used as they were as toners 1 to 15.

TABLE 2

| | Toner base | Organosilicon compound solution | | Core fine particle | | |
|---|---|---|---|---|---|---|
| Toner particle No. | particle dispersion liquid No. | Type No. | Amount added (parts) | Type | Number average particle diameter (nm) | Amount added (parts) |
| 1 | 1 | 1 | 13.3 | Silica fine particles (water glass method) | 32 | 1.0 |
| 2 | 1 | 2 | 13.3 | Silica fine particles (water glass method) | 81 | 4.0 |
| 3 | 1 | 3 | 13.3 | Silica fine particles (water glass method) | 275 | 4.0 |
| 4 | 1 | 4 | 10.0 | Silica fine particles (sol gel method) | 81 | 0.5 |
| 5 | 2 | 2 | 13.3 | Silica fine particles (water glass method) | 81 | 4.0 |
| 6 | 3 | 2 | 13.3 | Silica fine particles (water glass method) | 81 | 4.0 |
| 7 | 4 | 2 | 13.3 | Silica fine particles (water glass method) | 81 | 4.0 |
| 8 | 1 | 1 | 26.7 | Titanium oxide fine particles | 43 | 2.0 |
| 9 | 1 | 1 | 26.7 | Alumina fine particles | 49 | 2.0 |
| 10 | 1 | 1 | 26.7 | Acrylic resin fine particle | 105 | 5.0 |
| 11 | 1 | 1 | 26.7 | Silica fine particles (water glass method) | 81 | 0.2 |
| 12 | 1 | 5 | 13.3 | Silica fine particles (water glass method) | 81 | 6.0 |
| 13 | 1 | 1 | 6.7 | Silica fine particles (water glass method) | 15 | 1.0 |

TABLE 2-continued

| Toner particle No. | Toner base particle dispersion liquid No. | Organosilicon compound solution Type No. | Organosilicon compound solution Amount added (parts) | Core fine particle Type | Core fine particle Number average particle diameter (nm) | Core fine particle Amount added (parts) |
|---|---|---|---|---|---|---|
| 14 | 1 | 1 | 3.3 | Silica fine particles (water glass method) | 486 | 8.0 |
| 15 | 1 | 1 | 1.7 | Silica fine particles (water glass method) | 81 | 5.0 |

Production Example of Toner Particles 16

The aqueous medium 1 was prepared in the same manner as in the Production Example of the toner base particle dispersion liquid 1.

Production Example of Polymerizable Monomer Composition

| | |
|---|---|
| Styrene | 60.0 parts |
| Colorant (C.I. Pigment Blue 15:3) | 6.5 parts |

The materials were charged into an attritor (produced by Nippon Coke & Engineering Co., Ltd.) and further dispersed for 5.0 h at 220 rpm using zirconia particles having a diameter of 1.7 mm to prepare a dispersion in which the colorant was dispersed.

The following materials were added to the dispersion.

| | |
|---|---|
| Styrene | 20.0 parts |
| n-Butyl acrylate | 20.0 parts |
| Methyl triethoxysilane | 5.0 parts |
| Polyester resin (condensate of bisphenol A propylene oxide 2.0 mol adduct/terephthalic acid/trimellitic acid, glass transition temperature: 75° C.) | 5.0 parts |
| Fischer-Tropsch wax (melting point: 78° C.) | 7.0 parts |

The system was kept at 60° C. and then homogeneously dissolved and dispersed at 500 rpm by using the T. K. Homomixer to prepare a polymerizable monomer composition.

(Granulation Step)

The polymerizable monomer composition was charged into the aqueous medium 1 while keeping the temperature of the aqueous medium 1 at 70° C. and the rotational speed of the stirrer at 12,000 rpm, and the pH of the aqueous medium was adjusted to 5.5.

Next, 9.0 parts of t-butyl peroxypivalate as a polymerization initiator was added. The mixture was granulated for 10 min while maintaining the rotation speed of the stirrer at 12,000 rpm.

(Polymerization Step)

The high-speed stirring device was replaced with a stirrer equipped with a propeller stirring blade, and polymerization was conducted for 4.0 h, while stirring at 150 rpm and keeping the temperature at 70° C., to obtain a toner base particle dispersion liquid 5.

The weight average particle diameter (D4) of the toner base particles in the toner base particle dispersion liquid 5 was 7.3 μm, and the glass transition temperature (Tg) thereof was 58° C.

Further, ion-exchanged water was added to the toner base particle dispersion liquid 5 to adjust the concentration of the toner base particles in the dispersion to 20.0%.

Production Example of Fine Particle Dispersion 1

The following materials were charged into an autoclave equipped with a nitrogen gas introduction device, a temperature measurement device, and a stirring device.

| | |
|---|---|
| Methyl triethoxysilane | 3.0 parts |
| Fine particles (silica fine particles prepared by the water glass method, number average particle diameter 81 nm) | 4.0 parts |

After conducting the reaction for 5 h at 70° C. under a nitrogen atmosphere, the pH of the reaction product was adjusted to 5.5 and the temperature was adjusted to 70° C., and the reaction product was then kept for 1 h while mixing with a propeller stirring blade to obtain a fine particle dispersion 1.

(Step 1)

The following materials were weighed in a reaction container and mixed using a propeller stirring blade.

| | |
|---|---|
| Fine particle dispersion 1 | 7.0 parts |
| Toner base particle dispersion liquid 5 | 500.0 parts |

The pH of the resulting mixed liquid was adjusted to 5.5, the temperature of the mixture was brought to 85° C., and the mixture was kept for 3 h while mixing with a propeller stirring blade.

(Step 2)

Thereafter, the pH was adjusted to 9.0 by using a 1 mol/L NaOH aqueous solution, and the temperature was brought to 85° C. and kept for 4 h under stirring. Thereafter, the pH was adjusted to 1.5 with 1 mol/L hydrochloric acid, and the system was stirred for 1 h and filtered, while washing with ion-exchanged water, to obtain toner particles 16 in which the fine particles were present on the surface of the toner base particles.

The obtained toner particles 16 were directly used as toner 16.

Production Example of Toner 17

The toner base particle dispersion liquid 1 obtained in the polymerization step of the Production Example of the toner base particle dispersion Liquid 1 was filtered, and the filtered solid was washed with 720.0 parts of ion-exchanged water under stirring for 1.0 h.

Further, the solution containing the toner base particles was filtered and dried using a vacuum dryer to obtain toner base particles 1.

A total of 4.0 parts of hydrophilic silica fine particles having a number average particle diameter of 80 nm prepared by a sol-gel method were mixed with 100.0 parts of the toner base particles 1 with an FM mixer (Nippon Coke & Engineering Co., Ltd.) to obtain a toner 17.

Production Example of Toner 18

A total of 4.0 parts of silica fine particles having a number average particle diameter of 80 nm and hydrophobilized with 4% by mass of hexamethyldisilazane were mixed with 100.0 parts of the toner base particles 1 with an FM mixer (Nippon Coke & Engineering Co., Ltd.) to obtain a toner 18.

Various physical properties of the obtained toners 1 to 18 are shown in Table 3.

TABLE 3

| Toner No. | Embedding ratio of fine particles | Methanol concentration (% by volume) | Coverage ratio A | Coverage ratio of fine particles | Fixed attachment ratio of fine particles |
|---|---|---|---|---|---|
| 1 | 63% | 14.2% | 32.4% | 34% | 96% |
| 2 | 58% | 18.5% | 54.8% | 51% | 95% |
| 3 | 70% | 17.5% | 59.6% | 15% | 94% |
| 4 | 65% | 15.9% | 5.4% | 6% | 94% |
| 5 | 64% | 17.5% | 50.4% | 54% | 93% |
| 6 | 58% | 16.4% | 48.6% | 52% | 96% |
| 7 | 61% | 18.2% | 45.4% | 49% | 95% |
| 8 | 45% | 8.2% | 65.4% | 51% | 98% |
| 9 | 54% | 10.9% | 64.5% | 41% | 96% |
| 10 | 46% | 15.1% | 67.5% | 51% | 75% |
| 11 | 25% | 6.2% | 84.3% | 3% | 95% |
| 12 | 81% | 21.2% | 93.2% | 76% | 95% |
| 13 | 56% | 18.2% | 2.4% | 51% | 98% |
| 14 | 32% | 17.6% | 0.4% | 17% | 64% |
| 15 | 14% | 3.4% | 1.2% | 63% | 48% |
| 16 | 24% | 34.5% | 86.4% | 71% | 68% |
| 17 | 43% | 18.1% | 0.0% | 63% | 15% |
| 18 | 46% | 65.2% | 0.0% | 63% | 12% |

In Table 3, the "Coverage ratio A (% by area)" means the coverage ratio of the condensate of an organosilicon compound on the surface of the toner base particle excluding the fine particles, the "Coverage ratio (% by area) of fine particles" means the coverage ratio of the fine particles on the toner base particle surface, and the "Fixed attachment ratio of fine particles" means the fixed attachment ratio of the fine particles to the toner base particle.

Examples 1 to 14 and Comparative Examples 1 to 4

The toners 1 to 18 were used to evaluate Examples 1 to 14 and Comparative Examples 1 to 4.

A color laser printer (LBP-7700C, produced by Canon Inc.) was used, the toner of the cyan cartridge was taken out, and 160 g of each toner was filled in this cartridge. Transferability and member contamination were evaluated using the cartridge after filling.

<Evaluation of Transferability (Transfer Efficiency)>

In a normal temperature and normal humidity environment (23° C., 60% RH), the cartridge after filling was mounted on a cyan station of the printer and a solid image (toner loading amount 0.40 mg/cm$^2$) was outputted at a process speed of 240 mm/sec by using A4 plain paper Office 70 (Canon Marketing Japan Inc., 70 g/m$^2$). Thereafter, the apparatus was stopped during the transfer from the photosensitive member to the intermediate transfer member, and the toner laid-on level M1 (mg/cm$^2$) on the photosensitive member before the transfer process and the toner laid-on level M2 (mg/cm$^2$) on the photosensitive member after the transfer process were measured. Using the obtained toner laid-on levels, the transfer efficiency was calculated from the following formula.

$$\text{Transfer efficiency (\%)}=(M1-M2)/M1\times 100$$

Next, using A4 plain paper Office 70 (Canon Marketing Japan Inc., 70 g/m$^2$), 8000 charts were continuously printed at a print percentage of 2%, and the transfer efficiency was similarly calculated.

Evaluation criteria are as follows.

A: Transfer efficiency is at least 95%

B: Transfer efficiency is at least 90% and less than 95%

C: Transfer efficiency is at least 85% and less than 90%

D: Transfer efficiency is less than 85%

<Evaluation of Contamination of Charging Member>

In a low-temperature and low-humidity environment (10° C., 15% RH), the filled cartridge was mounted on the cyan station of the printer. Using A4 plain paper Office 70 (Canon Marketing Japan Inc., 70 g/m$^2$), 2000 charts were continuously printed at a print percentage of 30% while replenishing the toner, and then a halftone image was printed.

When the charging member is contaminated, charging non-uniformity occurs on the photosensitive member, and image density non-uniformity of the halftone image occurs.

Evaluation criteria are as follows.

A: The image density is uniform and there is no non-uniformity

B: There is very slight non-uniformity in image density

C: There is slight non-uniformity in image density

D: There is non-uniformity in image density

<Evaluation of Charge Rising Performance>

In a low-temperature and low-humidity environment (10° C., 15% RH), the following evaluation was made.

A total of 19.0 g of a magnetic carrier F813-300 (produced by Powdertech Co., Ltd.) and 1.0 g of the evaluation toner were placed in a 50 mL plastic bottle with a lid. Two such samples were prepared.

Two-component developers were prepared by shaking for 10 min and 30 min, respectively, at a speed of four reciprocations per second in a shaker (YS-LD, produced by Yayoi Co., Ltd.).

Figure 4:
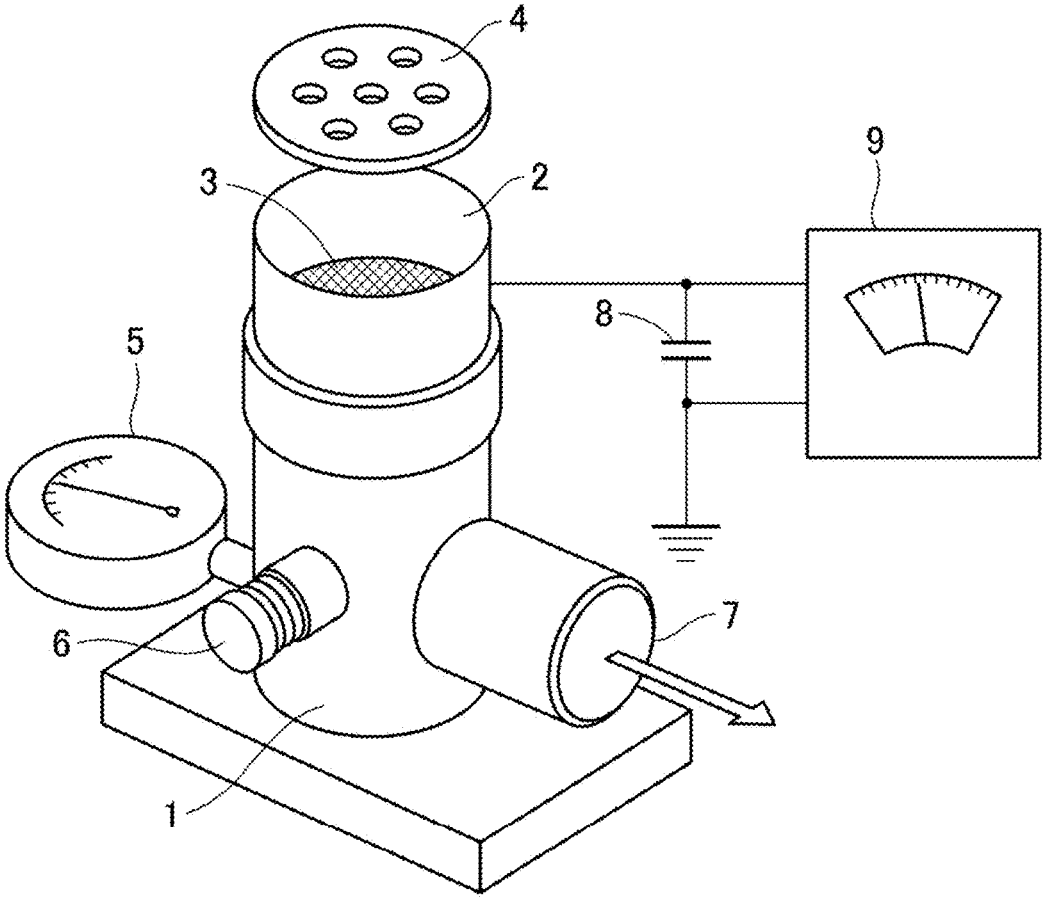
FIG. 4 is a schematic diagram of a charge quantity measuring apparatus.

A total of 0.200 g of a two-component developer for which the triboelectric charge quantity was to be measured was placed in a metal measurement container 2 having a screen 3 of 500 mesh (mesh size of 25 m) shown in FIG. 4, and a metallic lid 4 was placed thereon. The mass of the entire measurement container 2 at this time was weighed to be W1 (g).

Next, in a suction device 1 (at least the portion which is in contact with the measurement container 2 is an insulator), suction was performed from the suction port 7, the air flow rate adjustment valve 6 was adjusted, and the pressure of the vacuum gauge 5 was set to 50 mm Aq. In this state, the toner was sucked for 1 min and removed.

The potential of a potentiometer 9 at this time was taken as V (Volt). Here, 8 is a capacitor and the capacitance is C (μF). The weight of the entire measurement container after suction was weighed and denoted by W2 (g). The triboelectric charge quantity of the toner was calculated by the following formula.

$$\text{Triboelectric charge quantity}(mC/kg)=(C\times V)/(W1-W2)$$

("Triboelectric charge quantity after shaking for 10 min")/("triboelectric charge quantity after shaking for 30 min") was calculated, and the result was regarded as the charge rising performance and evaluated according to the following criteria.

A: Charge rising performance is at least 90%

B: Charge rising performance is at least 70% and less than 90%

C: Charge rising performance is at least 50% and less than 70%

D: Charge rising performance is less than 50%

<Evaluation of Charge Quantity Stability by Environment>

The following evaluations were carried out under a low-temperature and low-humidity environment (10° C., 15% RH) and under a high-temperature and high-humidity environment (30° C., 80% RH).

A total of 19.0 g of a magnetic carrier F813-300 (produced by Powdertech Co., Ltd.) and 1.0 g of the evaluation toner were placed in a 50 mL plastic bottle with a lid.

A two-component developer was prepared by shaking for 10 min at a speed of four reciprocations per second in a shaker (YS-LD, produced by Yayoi Co., Ltd.).

The triboelectric charge quantity was measured similarly to the evaluation of the charge rising performance.

("The triboelectric charge quantity in a high-temperature and high-humidity environment")/("the triboelectric charge quantity in a low-temperature and low-humidity environment") was calculated, and the result was regarded as the charge quantity stability by environment and evaluated according to the following criteria.

A: Charge quantity stability is at least 60%

B: Charge quantity stability is at least 40% and less than 60%

C: Charge quantity stability is at least 20% and less than 40%

D: Charge quantity stability is less than 20%

The evaluation results are shown in Tables 4 and 5.

TABLE 4

| | Toner No. | Charging member contamination | Transferability | | | |
|---|---|---|---|---|---|---|
| | | | Initial | | After 8000 prints | |
| Example 1 | Toner 1 | A | 95% | A | 95% | A |
| Example 2 | Toner 2 | A | 97% | A | 97% | A |
| Example 3 | Toner 3 | A | 99% | A | 98% | A |
| Example 4 | Toner 4 | A | 97% | A | 97% | A |
| Example 5 | Toner 5 | A | 97% | A | 97% | A |
| Example 6 | Toner 6 | A | 97% | A | 97% | A |
| Example 7 | Toner 7 | A | 97% | A | 97% | A |
| Example 8 | Toner 8 | A | 96% | A | 95% | A |
| Example 9 | Toner 9 | A | 96% | A | 95% | A |
| Example 10 | Toner 10 | A | 95% | A | 92% | B |
| Example 11 | Toner 11 | A | 96% | A | 91% | B |
| Example 12 | Toner 12 | B | 94% | B | 84% | C |
| Example 13 | Toner 13 | A | 91% | B | 89% | C |
| Example 14 | Toner 14 | C | 94% | B | 93% | B |
| Comparative Example 1 | Toner 15 | D | 97% | A | 87% | C |
| Comparative Example 2 | Toner 16 | C | 96% | A | 92% | B |
| Comparative Example 3 | Toner 17 | D | 93% | B | 83% | D |
| Comparative Example 4 | Toner 18 | D | 92% | B | 82% | D |

TABLE 5

| | Toner No. | Charge quantity | | | | | | |
|---|---|---|---|---|---|---|---|---|
| | | Under low-temperature and low-humidity environment | | Under high-temperature and high-humidity environment | | | | |
| | | Shaking for 10 min (mC/kg) | Shaking for 30 min (mC/kg) | Shaking for 10 min (mC/kg) | Charge rising performance | | Charge quantity stability | |
| Example 1 | Toner 1 | 30 | 32 | 24 | 94% | A | 80% | A |
| Example 2 | Toner 2 | 28 | 29 | 21 | 97% | A | 75% | A |
| Example 3 | Toner 3 | 23 | 25 | 15 | 92% | A | 68% | A |
| Example 4 | Toner 4 | 24 | 25 | 19 | 96% | A | 79% | A |
| Example 5 | Toner 5 | 28 | 29 | 21 | 97% | A | 75% | A |
| Example 6 | Toner 6 | 28 | 29 | 21 | 97% | A | 75% | A |
| Example 7 | Toner 7 | 28 | 29 | 21 | 97% | A | 75% | A |
| Example 8 | Toner 8 | 22 | 23 | 18 | 96% | A | 82% | A |
| Example 9 | Toner 9 | 21 | 23 | 16 | 91% | A | 76% | A |
| Example 10 | Toner 10 | 22 | 23 | 9 | 96% | A | 41% | B |
| Example 11 | Toner 11 | 18 | 19 | 8 | 95% | A | 44% | B |
| Example 12 | Toner 12 | 12 | 14 | 9 | 86% | B | 75% | A |
| Example 13 | Toner 13 | 31 | 33 | 20 | 94% | A | 65% | A |
| Example 14 | Toner 14 | 14 | 16 | 10 | 88% | B | 71% | A |

TABLE 5-continued

| | Toner No. | Charge quantity: Under low-temperature and low-humidity environment: Shaking for 10 min (mC/kg) | Shaking for 30 min (mC/kg) | Under high-temperature and high-humidity environment: Shaking for 10 min (mC/kg) | Charge rising performance | | Charge quantity stability | |
|---|---|---|---|---|---|---|---|---|
| Comparative Example 1 | Toner 15 | 21 | 22 | 8 | 95% | A | 38% | C |
| Comparative Example 2 | Toner 16 | 21 | 31 | 16 | 68% | C | 46% | B |
| Comparative Example 3 | Toner 17 | 21 | 24 | 4 | 88% | B | 19% | D |
| Comparative Example 4 | Toner 18 | 28 | 58 | 18 | 48% | D | 64% | A |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-096516, filed, May 15, 2017, which is hereby incorporated by reference herein in its entirety.

What is claimed is:

1. A toner comprising a toner particle including:

a toner base particle; and fine particles present on a surface of the toner base particle, wherein each of the fine particles includes:

a core fine particle; and a condensate of at least one organosilicon compound selected from the group consisting of an organosilicon compound represented by Formula (1) below and an organosilicon compound represented by Formula (2) below, the condensate coating the surface of the core fine particle, and in a wettability test of the toner with respect to a methanol/water mixed solvent, a methanol concentration, when a transmittance of light having a wavelength of 780 nm is 50%, is at least 5.0% by volume and not more than 20.0% by volume:

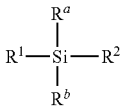

(1)

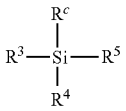

(2)

in Formulas (1) and (2), each of $R^a$, $R^b$ and $R^c$ independently represents an alkyl group, an alkenyl group, an acetoxy group, an acyl group, an aryl group, or a methacryloxyalkyl group, $R^1$, $R^2$, $R^3$, $R^4$ and $R^5$ each independently represents a halogen atom or an alkoxy group.

2. The toner according to claim 1, wherein the surface of the toner base particle excluding the fine particles is coated with the condensate of at least one organosilicon compound selected from the group consisting of the organosilicon compound represented by Formula (1) and the organosilicon compound represented by Formula (2).

3. The toner according to claim 1, wherein the core fine particle has a number average particle diameter of at least 10 nm and not more than 500 nm.

4. The toner according to claim 1, wherein the core fine particle has a number average particle diameter of at least 30 nm and not more than 300 nm.

5. The toner according to claim 1, wherein a coverage ratio of the surface of the toner base particle with the fine particles is at least 5% by area and not more than 70% by area.

6. The toner according to claim 1, wherein the core fine particle is a resin fine particle or an inorganic fine particle.

7. The toner according to claim 1, wherein a fixed attachment ratio of the fine particles to the toner base particle is at least 70% and not more than 100%.

8. The toner according to claim 1, wherein where a distance between a highest point of a portion of the fine particle protruding from the toner base particle and a lowest point of a deepest portion of the embedded fine particle in the toner base particle is defined as a fine particle diameter R, and a distance between the lowest point of the deepest portion of the embedded fine particle in the toner base particle and the surface of the toner base particle is defined as a fine particle embedding length r, an embedding ratio of the fine particle to the toner base particle expressed by $r/R \times 100$ is at least 20% and not more than 80%.

* * * * *